United States Patent [19]

Kobayashi et al.

[11] 4,428,542

[45] Jan. 31, 1984

[54] WIRE-DRIVING DEVICE FOR WINDOW REGULATOR

[75] Inventors: Tetuo Kobayashi, Ikeda; Syoichi Hirai, Nishinomiya, both of Japan

[73] Assignee: Nippon Cable System, Inc., Hyogo, Japan

[21] Appl. No.: 341,141

[22] Filed: Jan. 20, 1982

[30] Foreign Application Priority Data

Jul. 27, 1981 [JP] Japan ..... 56-118243
Aug. 8, 1981 [JP] Japan ..... 56-124439

[51] Int. Cl.[3] ..... B66F 11/00; E05F 11/48

[52] U.S. Cl. ..... 242/54 R; 49/332; 49/352; 74/505

[58] Field of Search ..... 254/342, 289, 299, 302; 74/89.2, 89.22, 505, 506; 49/332, 352, 325, 349; 242/54 R

[56] References Cited

U.S. PATENT DOCUMENTS 915,114 3/1909 Robin ..... 74/89.2 X
2,555,859 6/1951 Rappl et al. ..... 49/352
2,617,315 11/1952 McClelland ..... 74/89.2 X
4,158,270 6/1979 Cherbourg et al. ..... 49/352 X
4,191,060 3/1980 Sessa ..... 254/342 X
4,234,166 11/1980 Cederblad ..... 242/54 R X
4,235,117 11/1980 Pickles ..... 74/89.2

FOREIGN PATENT DOCUMENTS 54-31143 10/1979 Japan .

*Primary Examiner*—Stuart S. Levy
*Assistant Examiner*—Scott J. Haugland
*Attorney, Agent, or Firm*—Armstrong, Nikaido, Marmelstein & Kubovcik

[57] ABSTRACT

A compact and thin wire-driving device for a window regulator which absorbs elongation of wire automatically, wherein both ends of a driving wire are wound round two pulleys arranged parallel, i.e. a first pulley and a second pulley, in the same direction; a first gear is secured coaxially to the first pulley; a second gear is adjacent coaxially to the second pulley through ratchet teeth; the first gear and second gear are meshed to each other; and, when the wire is wound up round the first pulley, a slack of the wire is wound up round the first pulley and the second pulley remains stopped.

10 Claims, 7 Drawing Figures

WIRE-DRIVING DEVICE FOR WINDOW REGULATOR

BACKGROUND OF THE INVENTION

The present invention relates to a novel wire-driving device for a window regulator, and more particularly to a wire-driving device which can absorb automatically elongation generated in a wire for transmitting power from the wire-driving device to a working device for raising and lowering of a window glass.

Hitherto, a wire-driving type window regulator which has a wire secured to window glass and wound up or wound off to perform a slidably opening or closing action of a window glass in a building or a vehicle is well used, for changing rotational reciprocating operation of operating member into linear reciprocating motion of a window glass. Such a window regulator has some advantages, e.g. light weight and simple mechanism, due to using a wire as a transmission means. However, such a window regulator has a disadvantage in that elongation is generated in a wire in use, due to the characteristic of the wire. For that reason, elongation of the wire generates play in the rotational reciprocating operation of the driving device, so that the working device fails to accurately follow the driving device. Furthermore, elongation of the wire results in snapping of the wire due to repetitive bending of the wire, and further the wire is in danger of coming off a pulley, whereby the device becomes uncontrolable.

In order to eliminate these disadvantages, a length-adjusting member such as bolt-nut system or tension pulley system has been generally provided to the window regulator of the wire type to absorb elongation of the wire. However, in those systems, elongation of the wire must be adjusted each time there is elongation. Also, the adjustment is very troublesome, and some securing positions bring difficulties into the adjustment.

Recently, in order to eliminate these disadvantages, a transmission device capable of absorbing elongation of the wire has been suggested. This device comprises two pulleys which are provided coaxially and rotatably on a shaft and have ratchet teeth on their inner surface facing the shaft; a wire both end portions of which are respectively wound round the pulleys in an opposite direction to each other; and at least two pawls provided at the outer surface of the shaft, and respectively meshed with the above ratchet teeth. The ratchet teeth of the two pulleys are formed in the opposite direction to each other so that when the shaft is rotated in either direction, the ratchet teeth of one of pulleys are engaged with the pawl to stop the rotation of the pulley, the other pulley being freely rotatable, whereby elongation of the wire can be absorbed when the above other pulley is wound up the wire.

However, this suggested device has a problem in its strength, because the driving force is concentrated on the pawls. Therefore, the number of the pawls to be engaged with ratchet teeth must be increased. As a result, many parts are necessary in assembly of the device, and the assembly becomes very troublesome.

Also, because the device comprises two pulleys coaxially on a shaft, this device is very thick, and as a result, a wide space is required for a window regulator in a door panel of an automobile. Furthermore, to be coupled with an electric motor in a power window, the window regulator is required to be thinner.

OBJECTS OF THE INVENTION

The main object of the invention is to provide a compact and thin wire-driving device for a window regulator which can automatically absorb the permanent elongation produced in the power transmission wire connecting a driving device and a working device, and which can accurately drive the working device under a constant tension.

Another object of the invention is to provide a wire driving a window regulator for absorbing elongation of a wire which can eliminate the tension-adjustment required in its assembly.

Other objects and advantages of the invention will become apparent from the following description with reference to drawings.

DETAILED EXPLANATION OF THE INVENTION

Figure 1:
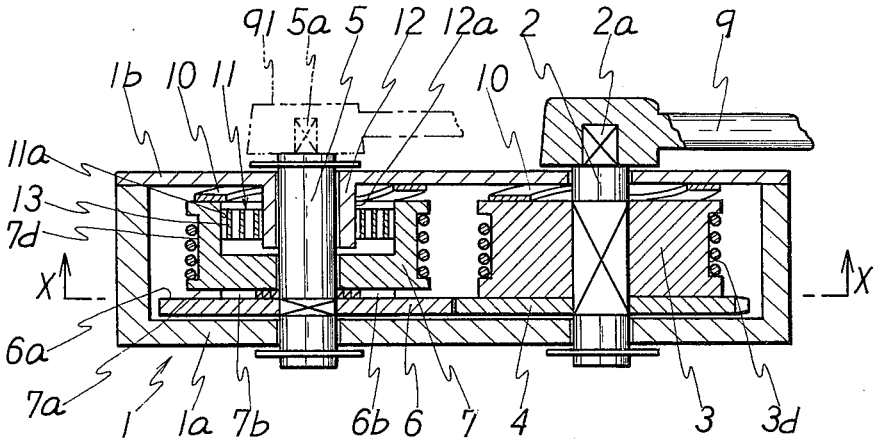
FIG. 1 is a sectional view for showing an embodiment of a wire-driving device in accordance with the invention.

In FIG. 1, 1*a* and 1*b* are a main body and a lid, respectively, forming a casing 1. 2 is a first shaft rotatably supported by the casing 1, and a first pulley 3 and a first gear 4 are secured to the shaft 2. 5 is a second shaft rotatably supported by the casing 1 in parallel with the first shaft 2. A second gear 6 is secured to the second shaft 5, and a second pulley 7 is rotatably supported on the second shaft 5, and is axially movable in some degree. The first gear 4 and the second gear 6 are meshed. The second gear 6 and the second pulley 7 are respectively provided with circular ratchet teeth 6*b*, 7*b* meshed with each other and each mounted respectively on inside facing surfaces 6*a* and 7*a* of the second gear 6 and second pulley 7.

Figure 2:
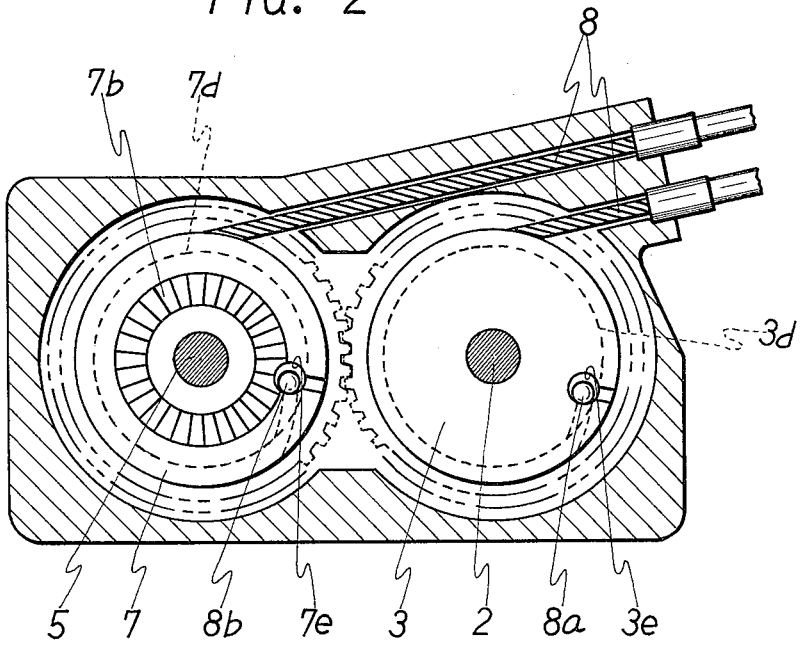
FIG. 2 is an sectional view taken along line X—X of FIG. 1.

Each mesh direction of the ratchet teeth 6*b* and 7*b* is determined so as to transmit the rotational torque from the second gear 6 to the second pulley 7, when the second pulley 7 is rotated in the direction for winding up the wire. Each outer surface 3*d* and 7*d* of the first pulley 3 and second pulley 7 is provided respectively with a recess 3*e*, 7*e* which can fixedly secure ends 8*a* and 8*b* of the wire 8 (as shown in FIG. 2). Furthermore, in the embodiment shown in FIG. 1, one end of the first shaft 2 is provided with a portion 2*a* which protrudes out of the casing for connecting a lever 9 thereto.

The first shaft 2 may be driven by electric motor (not shown). Furthermore, in the embodiment, wave washers 10 are inserted between the lid 1*a* of casing and pulleys to brake the rotation of pulleys eliminating the influence of external force in the rest state, for giving the certain tensile force actively to the wire unwound from pulleys, and the second pulley 7 is provided with a space 11, and the lid 1*a* of casing is provided with a boss 12. A spiral spring 13 is contained in the space 11, and is engaged at one end thereof to the inner surface 11*a* of the second pulley 7 and is engaged at the other end thereof to the outer surface 12*a* of the boss 12. The spiral spring 13 urges the second pulley 7 in the direction that the second pulley 7 winds up the wire (in the direction D in FIG. 3). This spiral spring 13 provides a rewinding tensile force on the wire when the wire is unwound from the second pulley.

Hereinafter, the functions and advantages of the device of the invention will be explained.

Figure 3:
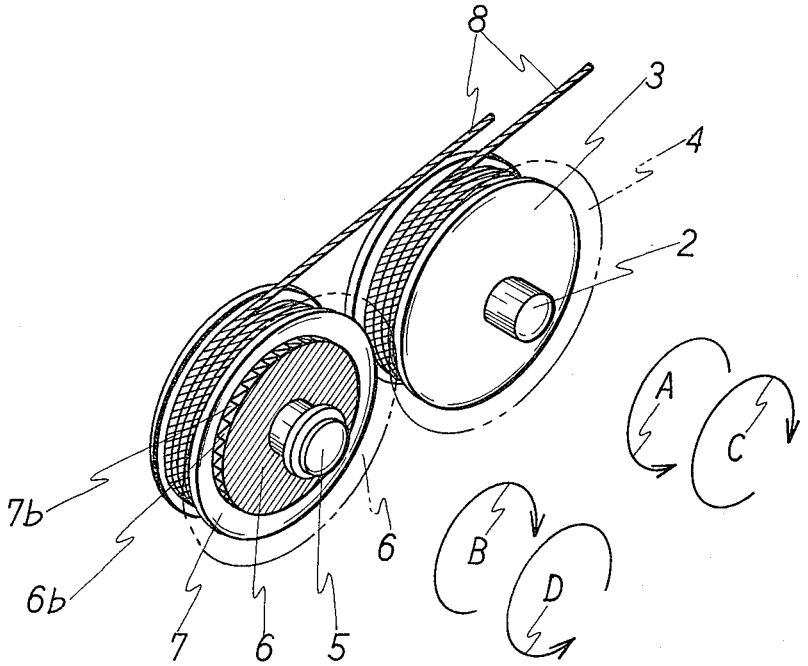
FIG. 3 is an partial perspective schematic showing the function of the embodiment shown in FIG. 1.

As shown in FIG. 3, when the lever 9 is rotated in the direction A, the wire 8 is wound up on the first pulley 3, and the working device (not shown) is driven. In that case, the torque of the lever 9 rotates the second gear 6 in the direction B through the first gear 4, but the torque is not transmitted to the second pulley 7, because the ratchet teeth 6*b* and 7*b* are disengaged. Thus, the second pulley 7 is rotated by only the drawing force of wire 8. When the wire 8 elongates so as to reduce or remove the tensile force, the lever 9, the first shaft 2, the first pulley 3, the first gear 4 and the second gear 6 are rotated, but the second pulley 7 is not rotated by the braking forces of the wave washer 10 and the spiral spring 13, until the tensile force of the wire 8 overcomes these braking forces.

When the lever 9 is rotated in the direction C, the first shaft 2, the first pulley 3 and the first gear 4 are also rotated in the direction C, and the second gear 6 is rotated in the direction D, and the second pulley 7 is rotated in the direction D through the ratchet teeth 6*b*, 7*b* by the rotation of the first pulley 3. Therefore, the wire 8 is wound up on the second pulley 7, and is played out from the first pulley 3. In that case, the elongation of wire 8 is not absorbed, because the wire is not drawn out from the first pulley by the tensile force of the wire 8.

It is apparent that the second shaft 5 can be provided with a portion 5*a* at the end thereof, and the lever 91 can be fixed to the portion 5*a*, as shown by the imaginary line of FIG. 1.

Figure 4:
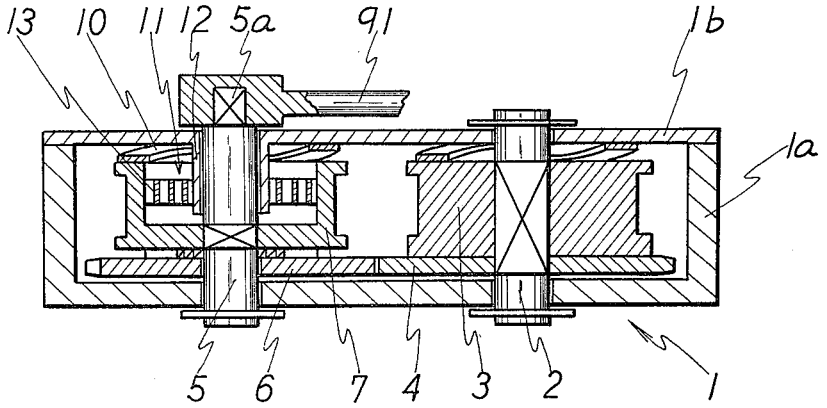
FIGS. 4 and 5 are sectional views showing other embodiments of the invention respectively.

In another embodiment shown in FIG. 4, the second gear 6 is rotatably supported on the surface of the second shaft 5 and is axially movable in some degree, and the second pulley 7 is fixed to the shaft. The functions of this embodiment structured as above is described below.

When the lever 91 and the second shaft 5 are rotated in the direction D, the wire 8 is wound around the second pulley, the working device is driven and the wire 8 is pulled out from the first pulley 3. In that case, the elongation of the wire 8 is absorbed. Conversely, when the lever 91 is rotated in the direction B, the ratchet teeth 6*b*, 7*b* are engaged, so that the first pulley 3 is rotated synchronously with the second pulley 7 and sends out the wire 8. In that case, the elongation of wire is not absorbed.

Figure 5:
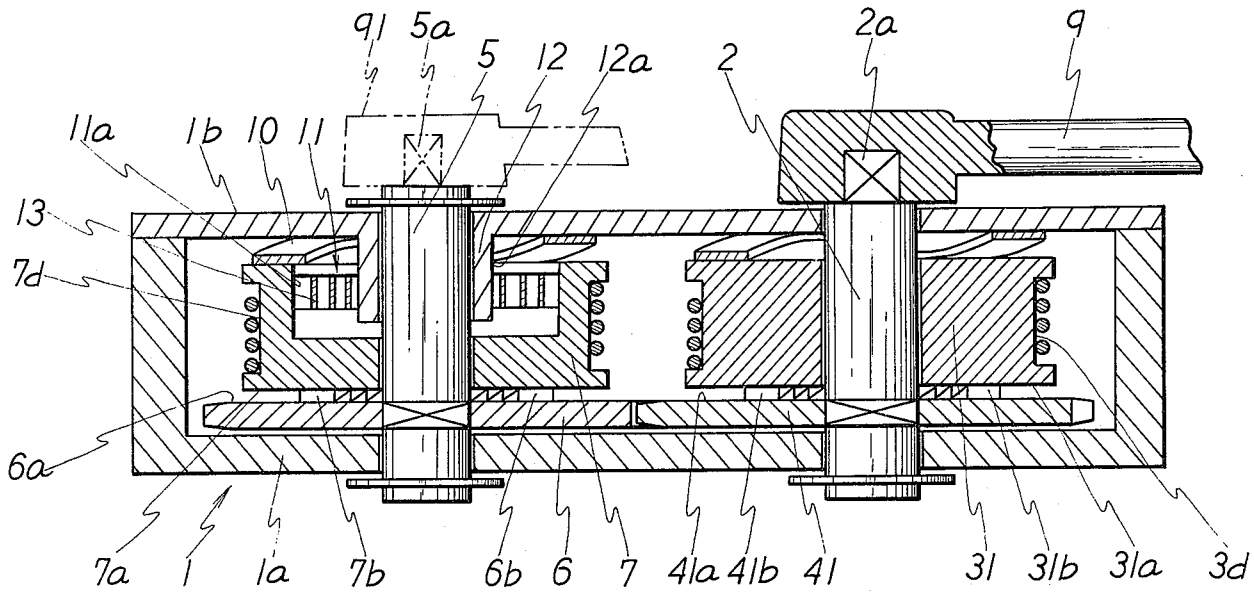
Figure 6:
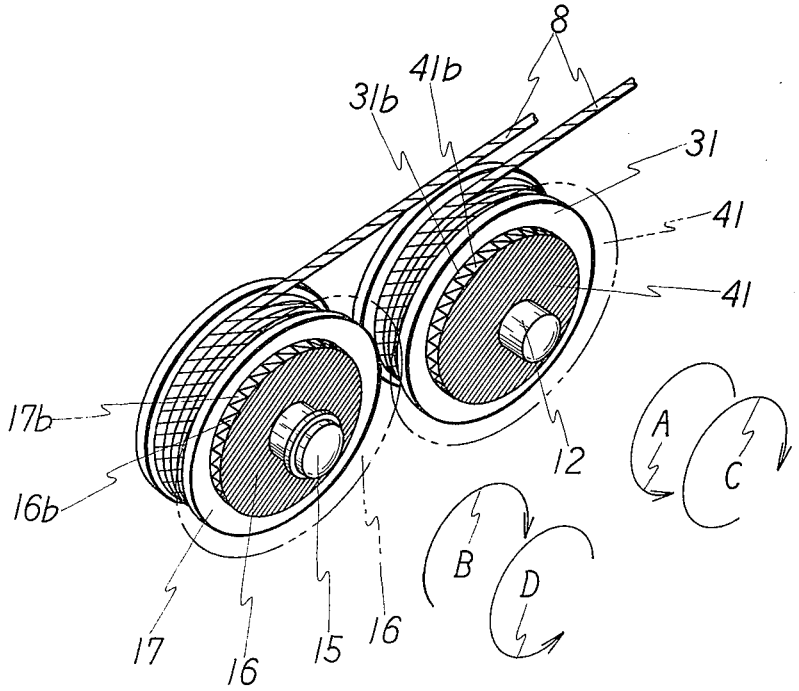
FIG. 6 is a partial perspective schematic explaining the function of the embodiment shown in FIG. 5.

The embodiment shown in FIG. 5 is almost similar to the embodiment shown in FIG. 1. In this embodiment, a first pulley 31 is rotatably supported on the first shaft 2, and is axially movable in some degree. Furthermore, the first gear 41 and the first pulley 31 are also respectively provided as inside surfaces 41*a* and 31*a* with circular ratchet teeth 41*b* and 31*b* which are meshed with each other. The shapes of the ratchet teeth 41*b* and 31*b* are the same as those of the ratchet teeth 7*b* and 6*b*.

In this embodiment, as shown in FIG. 5, when the lever 9 is rotated in the direction A, the rotational torque is transmitted to only the first pulley 31, and the second pulley 7 is rotated by the tensile force of the wire. When the lever 9 is rotated in the direction C, the rotational torque is transmitted to only the second pulley 7, and the first pulley 31 is rotated by the tensile force of the wire. In that case, when the lever 9 is rotated in the direction A or B, the elongation of the wire can be absorbed automatically. In this embodiment, it is also apparent that the lever 91 may alternatively be fixed to the second shaft 5.

Figure 7:
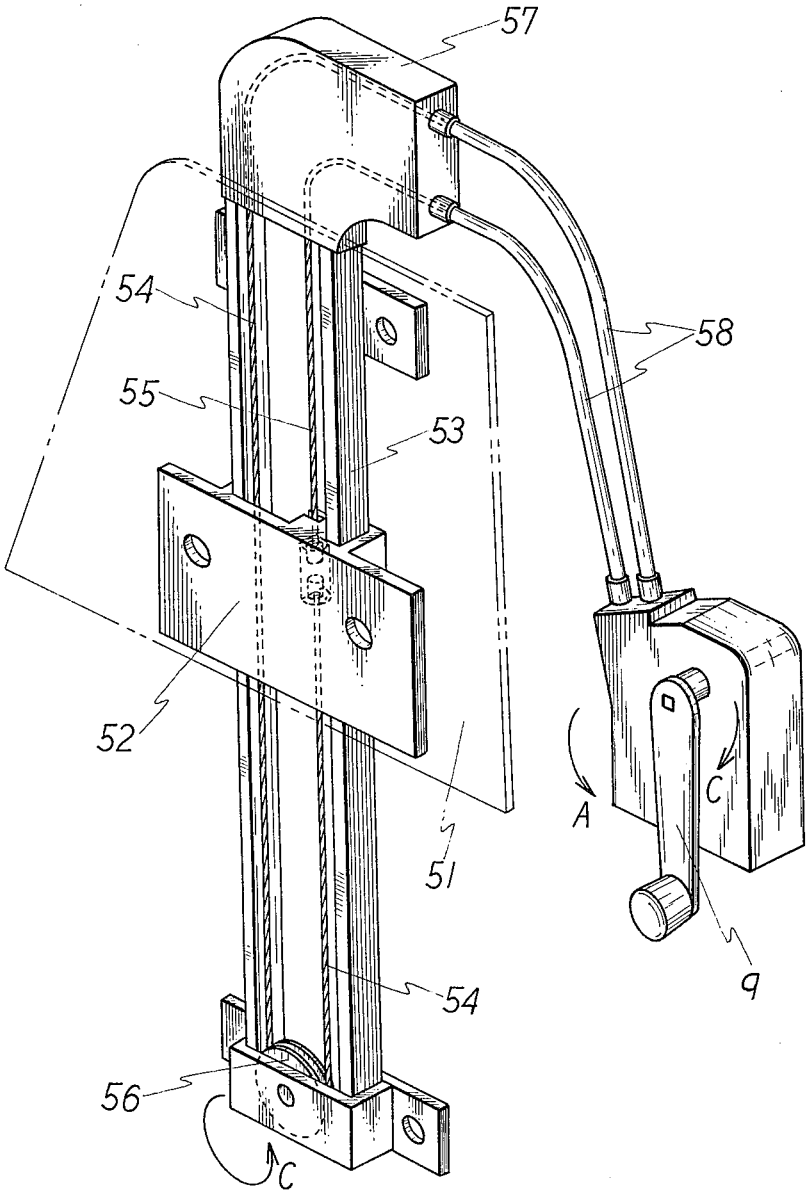
FIG. 7 is a schematic perspective view showing an embodiment of a window regulator employing a wire-driving device of the invention.

The wire-driving device of the invention can be used preferably for the window regulator of an automobile, or the like, as shown in the FIG. 7. In FIG. 7, a bracket 52 fixed to a window glass 51 is mounted slidably on a guide rail 53. Ends of two wires 54, 55 are connected to the bracket 52. The first wire 54 extends downward and encircles the periphery of a circular guide member 56 to end at the bracket 52. Furthermore the wire 55 extends upward from bracket 52 to a cable guide where the direction of both wires 54 and 55 is changed by 90°. Furthermore, the two wires are guided slidably by flexible guide tubes 58 the ends of which are respectively affixed to the cable guide 57 and to the casing of a wire-driving device. The drawing device end of the first wire 54 is engaged in a recess 3*e* perforated in the surface of the first pulley 3, and the drawing device end of the second wire 55 is engaged in a recess 7*e* perforated in the surface of the second pulley 7 as shown in FIGS. 1 to 2. And each end portion of the wires can be wound up round the first pulley 3 and the second pulley 7 respectively by rotating of the lever 9 in the direction A or C. When the wires are wound up in the direction of either A or C, the blacket 52 and the window glass 51 are operated upward or downward. In such a window regulator, elongation of the wire can be absorbed automatically. Also, in such a window regulator, the second wire 55 pulling up the window glass is engaged to the second pulley. As a result, the weight of the window glass can be balanced by the force urged by the spiral spring 13, and the lever 9 can be operated smoothly.

As described above, the wire-driving device of the invention is thin and compact due to the parallel arrangement of pulleys for winding and unwinding the wire, and can satisfy the requirement of the thinning of the door pannel in automobiles, or the like. Furthermore, due to providing the braking means, i.e. the wave washer or the spiral spring, against the pulleys, the operation of the window regulator can be ensured.

What is claimed is:

1. A wire-driving device for a window regulator comprising:

a casing;

a first shaft rotatably supported in said casing, said first shaft having a first pulley and a first gear mounted thereon;

a second shaft rotatably supported in said casing in parallel with said first shaft, said second shaft having a second gear and said second pulley mounted thereon; one of said second gear and said second pulley being fixedly mounted on said second shaft and the other being rotatably mounted and axially moveable on said second shaft, wherein said first gear and said second gear are meshed with each other, and wherein facing side surfaces of said second gear and second pulley each include a ratchet means for engaging each other when said second gear rotates in one direction relative to said second pulley and for not engaging each other when said second gear rotates in the opposite direction relative to said second pulley, and a wire having one end secured to each of said first and second pulleys and being wound around each pulley, such that said wire is unwound from said second pulley when said second pulley is rotated in a direction such that said ratchet means are not engaged.

2. The device of claim 1 wherein the end of said first shaft has a lever-securing portion.

3. The device of claim 1 wherein the end of said second shaft has a lever-securing portion.

4. The device of claim 1 wherein said second pulley and second gear are urged towards one another.

5. The device of claim 1 including a spiral spring coupled to said second pulley, one end of said spiral spring being fixed to said second pulley and the other end of said spiral spring being coupled to said casing, wherein said spiral spring urges said second pulley in a direction such that said second pulley winds up said wire.

6. A wire-driving device for a window regulator comprising:

a casing;

a first shaft rotatably supported in said casing, said first shaft having a first pulley and a first gear mounted thereon;

a second shaft rotatably supported in said casing in parallel with said first shaft, said second shaft having a second gear and a second pulley mounted thereon; one of said second gear and said second pulley being fixedly mounted on said second shaft and the other being rotatably mounted and axially moveable on said second shaft, wherein said first gear and said second gear are meshed with each other, and wherein facing side surfaces of said first gear and said first pulley each include first ratchet means for engaging each other when said first gear rotates in one direction relative to said first pulley and for not engaging each other when said first gear rotates in the opposite direction relative to said first pulley and facing side surfaces of said second gear and second pulley each include a second ratchet means for engaging each other when said second gear rotates in one direction relative to said second pulley and for not engaging each other when said second gear rotates in the opposite direction relative to said second pulley, and a wire having one end secured to each of said first and second pulleys and being wound around each pulley, such that said wire is unwound from said first pulley, when said first pulley is rotated in a direction such that said first ratchet means are not engaged and said wire is unwound from said second pulley when said second pulley is rotated in a direction such that said second ratchet means are not engaged.

7. The device of claim 6 wherein the end of said first shaft has a lever-securing portion.

8. The device of claim 6 wherein the end of said second shaft has a lever-securing portion.

9. The device of claim 6 wherein said second pulley and said second gear are urged towards one another.

10. The device of claim 6 including a spiral spring coupled to said second pulley, one end of said spiral spring being fixed to said second pulley and the other end of said spiral spring being coupled to said casing, wherein said spiral spring urges said second pulley in a direction such that said second pulley winds up said wire.

* * * * *